US008194013B2

(12) United States Patent
Choi

(10) Patent No.: US 8,194,013 B2
(45) Date of Patent: Jun. 5, 2012

(54) ORGANIC LIGHT EMITTING DISPLAY AND METHOD OF DRIVING THE SAME

(75) Inventor: Sang-Moo Choi, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 387 days.

(21) Appl. No.: 12/505,652

(22) Filed: Jul. 20, 2009

(65) Prior Publication Data

US 2010/0103203 A1 Apr. 29, 2010

(30) Foreign Application Priority Data

Oct. 23, 2008 (KR) ..... 10-2008-0104080

(51) Int. Cl.
*G09G 3/30* (2006.01)

(52) U.S. Cl. ..... 345/78; 345/690

(58) Field of Classification Search ..... 345/690, 345/82, 83, 76–78, 101
See application file for complete search history.

(56) References Cited

FOREIGN PATENT DOCUMENTS

| | | |
|---|---|---|
| JP | 2008-3456 | 1/2008 |
| KR | 10-2005-0083868 | 8/2005 |
| KR | 10-2005-0117464 A | 12/2005 |
| KR | 10-0637203 | 10/2006 |
| KR | 10-2007-0035388 A | 3/2007 |
| KR | 10-2008-0009595 | 1/2008 |

OTHER PUBLICATIONS

Office Action dated Apr. 26, 2010, issued by the Korean Intellectual Property Office.
Office Action issued in Korean Patent Application No. 10-2008-0104080 on Jun. 29, 2010.
English language abstract for Korean Patent Publication No. 10-2006-0081079.

*Primary Examiner* — Ricardo L Osorio
(74) *Attorney, Agent, or Firm* — Christie, Parker & Hale, LLP

(57) ABSTRACT

An organic light emitting display capable of minimizing power consumption. The organic light emitting display includes a plurality of pixels positioned at intersections of data lines and scan lines includes the pixels including driving transistors positioned in an effective display region to control an amount of current that flows from a first power source to a second power source, a data driver for supplying data signals to the data lines, a scan driver supplying scan signals to the scan lines, a first power source generator generating the first power source, a second power source generator generating the second power source, and a voltage controller controlling the second power source generator so that voltage of the second power source is changed in response to a first voltage applied to an organic light emitting diode (OLED) included in a specific pixel when a data signal corresponding to specific brightness is supplied from the data driver to the specific pixel.

17 Claims, 5 Drawing Sheets

ORGANIC LIGHT EMITTING DISPLAY AND METHOD OF DRIVING THE SAME

CROSS-REFERENCE TO RELATED APPLICATION

This application claims the benefit of Korean Patent Application No. 10-2008-0104080, filed Oct. 23, 2008, in the Korean Intellectual Property Office, the disclosure of which is incorporated herein by reference.

BACKGROUND OF THE INVENTION

1. Field of the Invention

Aspects of the present invention relate to an organic light emitting display and a method of driving the same, and more particularly, to an organic light emitting display capable of minimizing power consumption and a method of driving the same.

2. Description of the Related Art

Recently, various flat panel displays (FPD) having less weight and volume than cathode ray tubes (CRT) have been developed. The FPDs include liquid crystal displays (LCD), field emission displays (FED), plasma display panels (PDP), and organic light emitting displays.

Among the FPDs, the organic light emitting displays display images using organic light emitting diodes (OLED) that generate light by the re-combination of electrons and holes. The organic light emitting display has high response speed and is driven with low power consumption.

FIG. 1 is a circuit diagram illustrating a pixel of a conventional organic light emitting display.

Referring to FIG. 1, a pixel 4 of the conventional organic light emitting display includes an organic light emitting diode OLED and a pixel circuit 2 coupled to a data line Dm and a scan line Sn to control the OLED.

The anode electrode of the OLED is coupled to the pixel circuit 2 and the cathode electrode thereof is coupled to a second power source ELVSS. The OLED generates light with predetermined brightness to correspond to current supplied from the pixel circuit 2.

The pixel circuit 2 controls the amount of current supplied to the OLED to correspond to a data signal supplied to the data line Dm when a scan signal is supplied to the scan line Sn. To this end, the pixel circuit 2 includes a second transistor M2 coupled between a first power source ELVDD and the OLED, a first transistor M1 coupled between the second transistor M2, the data line Dm, and the scan line Sn, and a storage capacitor Cst coupled between the gate electrode and the first electrode of the second transistor M2.

The gate electrode of the first transistor M1 is coupled to the scan line Sn, the first electrode thereof is coupled to the data line Dm, and the second electrode thereof is coupled to the storage capacitor Cst. Here, the first electrode is set as one of a source electrode and a drain electrode and the second electrode is set as the other thereof different from the first electrode. For example, when the first electrode is set as the source electrode, the second electrode is set as the drain electrode. The first transistor M1, coupled to the scan line Sn and the data line Dm, is turned on when a scan signal is supplied from the scan line Sn to supply a data signal supplied from the data line Dm to the storage capacitor Cst. At this time, the storage capacitor Cst charges a voltage corresponding to the data signal.

The gate electrode of the second transistor M2 is coupled to one terminal of the storage capacitor Cst, the first electrode thereof is coupled to the other terminal of the storage capacitor Cst and the first power source ELVDD, and the second electrode thereof is coupled to the anode electrode of the OLED. The second transistor M2 controls the amount of current supplied from the first power source ELVDD to the second power source ELVSS via the OLED to correspond to a voltage value stored in the storage capacitor Cst. At this time, the OLED generates light corresponding to the amount of current supplied from the second transistor M2.

In the conventional the pixel 4, the second transistor M2 is driven as a constant current source that supplies uniform current to the OLED in response to a voltage stored in the storage capacitor Cst. Here, in order to operate the second transistor M2 as the constant current source, the second transistor M2 should be driven in a saturation region. Therefore, the voltage between the first power source ELVDD and the second power source ELVSS is set so that the second transistor M2 is driven in the saturation region.

Actually, the voltage between the first power source ELVDD and the second power source ELVSS can be expressed by the following EQUATION 1.

$$ELVDD-ELVSS>Vds_sat+Voled+Vmt+Vmo \quad \text{[EQUATION 1]}$$

In EQUATION 1, Vds_sat represents the minimum voltage value between the first electrode and the second electrode of the second transistor M2 for driving the second transistor M2 in the saturation region when the maximum current that can be supplied from a pixel circuit 2 to the OLED flows. Voled represents the voltage value applied to the OLED when the maximum current is supplied.

Vmt represents the voltage margin voltage value caused by the process deviation of the second transistor M2 and Vmo represents the margin voltage value corresponding to the process deviation and the temperature characteristic of the OLED. Actually, although the same current is supplied to the OLED, the value of the voltage applied to the OLED changes in response to the temperature at which the OLED is currently driven. Therefore. Vmo is set so that the pixel 4 can be stably driven in consideration of the temperature characteristic of the OLED.

Meanwhile, when the voltage of the first power source ELVDD and the second power source ELVSS is set by the EQUATION 1, power consumption increases. In particular, the margin voltage of Vmo added in consideration of the temperature characteristic occupies 20% to 30% of the power consumption. Therefore, a method of reducing the power consumption by reducing the voltage of Vmo is required.

SUMMARY OF THE INVENTION

Accordingly, aspects of the present invention provide an organic light emitting display capable of minimizing power consumption and a method of driving the same.

In order to achieve the foregoing and/or other objects of the present invention, according to a first aspect of the present invention, there is provided an organic light emitting display including a plurality of pixels positioned at intersections of data lines and scan lines. The organic light emitting display comprises the pixels including driving transistors positioned in an effective display region to control an amount of current that flows from a first power source to a second power source, a data driver supplying data signals to the data lines, a scan driver supplying scan signals to the scan lines, a first power source generator generating the first power source, a second power source generator generating the second power source, and a voltage controller controlling the second power source generator so that a voltage of the second power source is changed in response to a first voltage applied to an organic light emitting diode (OLED) included in a specific pixel when a data signal corresponding to specific brightness is supplied from the data driver to the specific pixel.

The specific pixel comprises a first transistor whose turning on point of time is controlled so that the first voltage can be supplied to the voltage controller. The voltage controller comprises a controller controlling turning on and off of the first transistor, a memory storing a sum voltage of a voltage for driving the driving transistor in a saturation region and a margin voltage caused by a process deviation of the driving transistor as first data, a first digital-to-analog converter (DAC) converting the first data into a second voltage, an adder adding the first voltage to the second voltage to generate a third voltage, a comparator comparing the third voltage with the voltage value of the first power source, a register generating second data whose bits are increased and reduced in response to a comparison result of the comparator, and a second DAC converting the second data into an analog voltage.

According to a second aspect of the present invention, there is provided a method of driving an organic light emitting display comprising pixels for controlling current that flows from a first power source to a second power source. The method comprises storing a sum voltage of a voltage for driving transistors in a saturation region when the driving transistors included in the pixels supply current corresponding to the highest gray level and a voltage in consideration of a process deviation of the driving transistors in a memory as first data, supplying current corresponding to the maximum gray level to an organic light emitting diode (OLED) included in at least one specific pixel through a data line, comparing a third voltage that is a sum voltage of a first voltage extracted from the OLED in response to the current of the maximum gray level and a second voltage generated by changing the first data into an analog signal with the first power source, and controlling a voltage value of the second power source in response to the comparison result.

The voltage value of the second power source is controlled so that the third voltage becomes similar to the voltage of the first power source.

In the organic light emitting display according to aspects of the present invention and the method of driving the same, since the voltage value of the second power source is set to correspond to the temperature at which the OLED is currently driven, it is possible to reduce power consumption.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
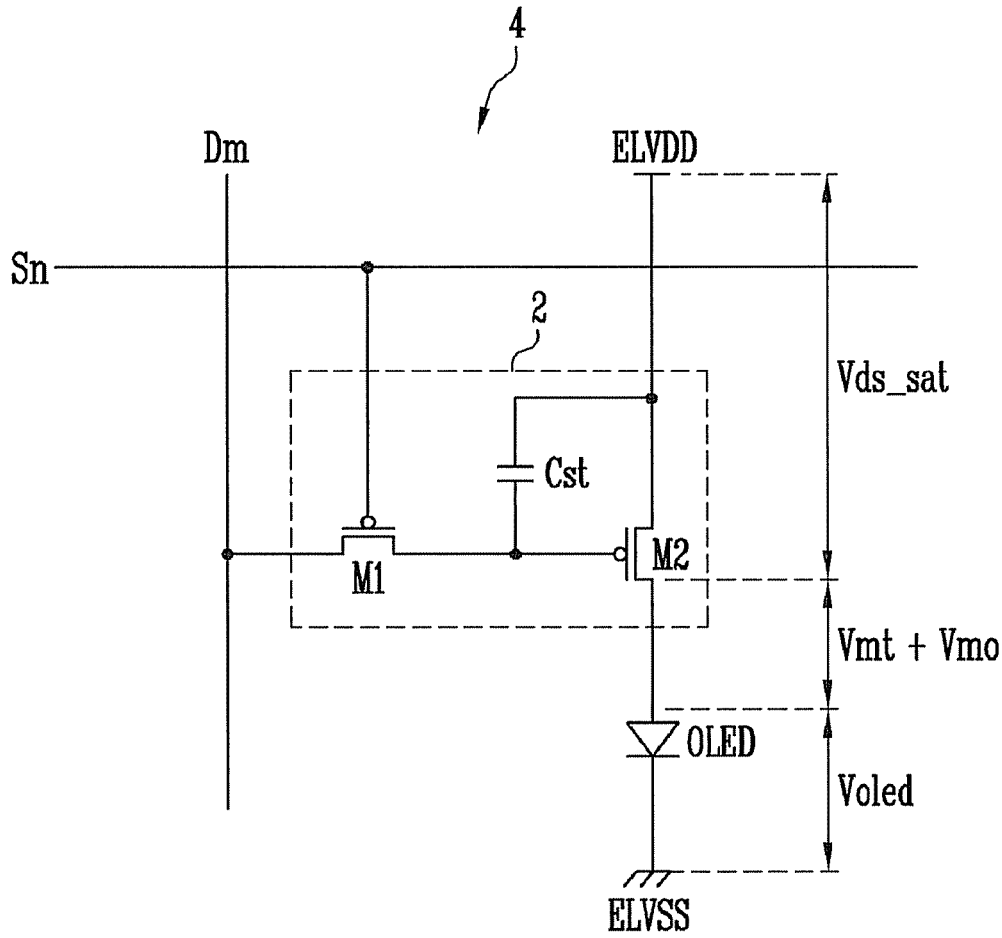
FIG. 1 illustrates a pixel of a common organic light emitting display.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

Figure 2:
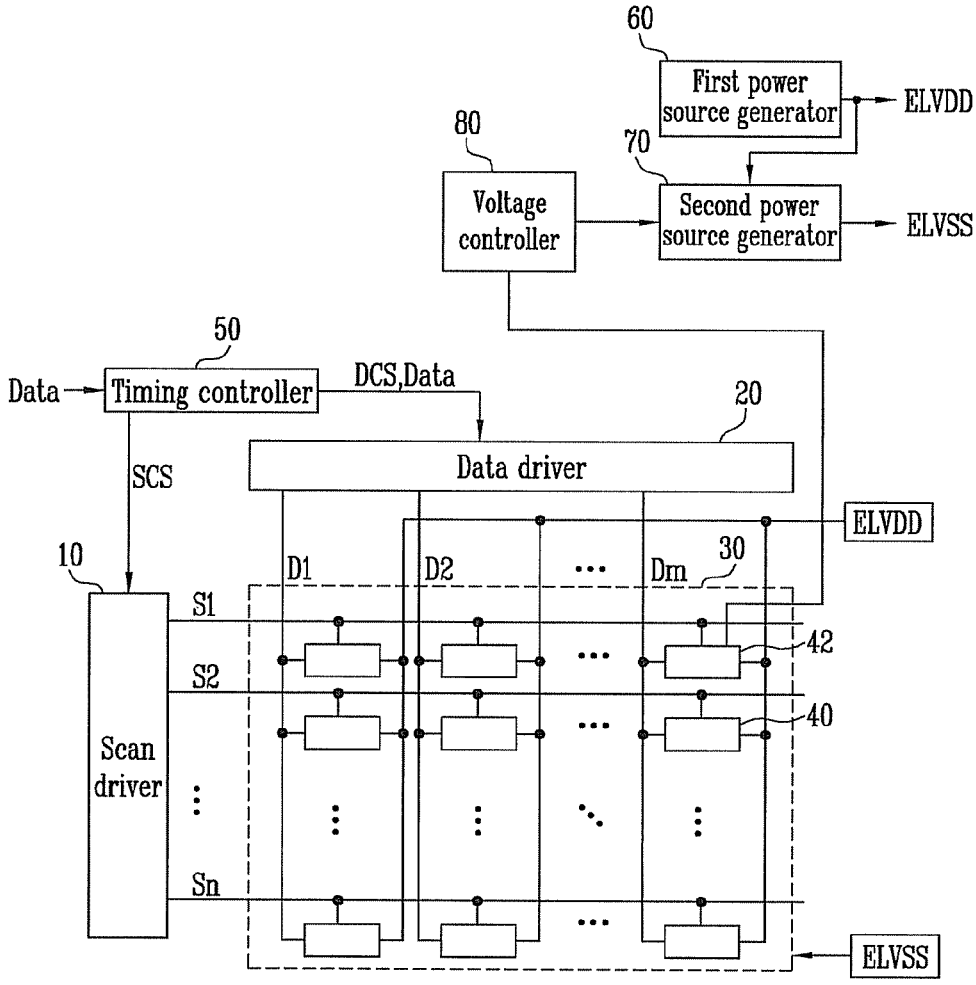
FIG. 2 illustrates an organic light emitting display according to a first embodiment of the present invention.

FIG. 2 illustrates an organic light emitting display according to an embodiment of the present invention.

Referring to FIG. 2, an organic light emitting display according to an embodiment of the present invention includes a pixel unit (that is, an effective display unit) 30 including a plurality of pixels 40 and 42 coupled to scan lines 81 to Sn and data lines D1 to Dm, a scan driver 10 to drive the scan lines S1 to Sn, a data driver 20 to drive the data lines D1 to Dm, and a timing controller 50 to control the scan driver 10 and the data driver 20.

In addition, the organic light emitting display according to an embodiment of the present invention includes a first power source generator 60 to generate the first power source ELVDD, a voltage controller 80 to control a second power source generator 70 in response to the voltage extracted from the specific pixel 42, and the second power source generator 70 to generate the second power source ELVSS by controlling the voltage controller 80.

The pixel unit 30 receives power from both the first power source ELVDD, which is supplied from the first power source generator 60, and the second power source ELVSS, which is supplied from the second power source generator 70, and transfers both to the pixels 40 and 42. The pixels 40 and 42 that received the first power source ELVDD and the second power source ELVSS are selected when the scan signals are supplied to emit light with the brightness corresponding to the data signals.

To this end, each of the pixels 40 includes an OLED (not shown) and a pixel circuit (not shown) to supply current to the OLED. The pixel circuit includes at least one transistor and capacitor. The driving transistor included in the pixel circuit controls the amount of the current supplied from the first power source ELVDD to the second power source ELVSS through the OLED in response to the data signals. The OLED emits red, green, or blue light in response to the amount of the current supplied from the pixel circuit.

The scan driver 10 sequentially supplies the scan signals to the scan lines S1 to Sn. When the scan signals are sequentially supplied to the scan lines S1 to Sn, the pixels 40 and 42 are sequentially selected in units of lines.

The data driver 20 generates the data signals using the data supplied from the timing controller 50 and supplies the generated data signals to the data lines D1 to Dm whenever the scan signals are supplied. Then, the data signals are supplied to the pixels 40 and 42 selected by the scan signals.

The timing controller 50 generates data driving control signals DCS and scan driving control signals SCS in response to synchronizing signals supplied externally. The data driving control signals DCS generated by the timing controller 50 are supplied to the data driver 20 and the scan driving control signals SCS are supplied to the scan driver 10. Then, the timing controller 50 realigns the externally supplied data to supply the realigned data to the data driver 20.

The voltage controller 80 is coupled to at least one specific pixel 42 included in the pixel unit 30. The voltage controller 80 extracts the voltage applied to the OLED of the specific pixel 42 when the data signal corresponding to the maximum brightness is supplied to the specific pixel 42 (that is, the maximum current flows to the OLED of the specific pixel 42). At this time, the voltage extracted from the OLED includes the voltage information applied to the OLED in response to the temperature at which the OLED is currently driven (that is, Vmo+Voled). The voltage controller 80 that extracted a predetermined voltage from the specific pixel 42 controls the second power source generator 70 so that the power consumption can be minimized.

The second power source generator 70 generates the second power source ELVSS in response to the control of the voltage controller 80 to supply the generated second power source ELVSS to the pixels 40 and 42. The first power source generator 60 generates the first power source ELVDD to supply the generated first power source ELVDD to the pixels 40 and 42.

Figure 3:
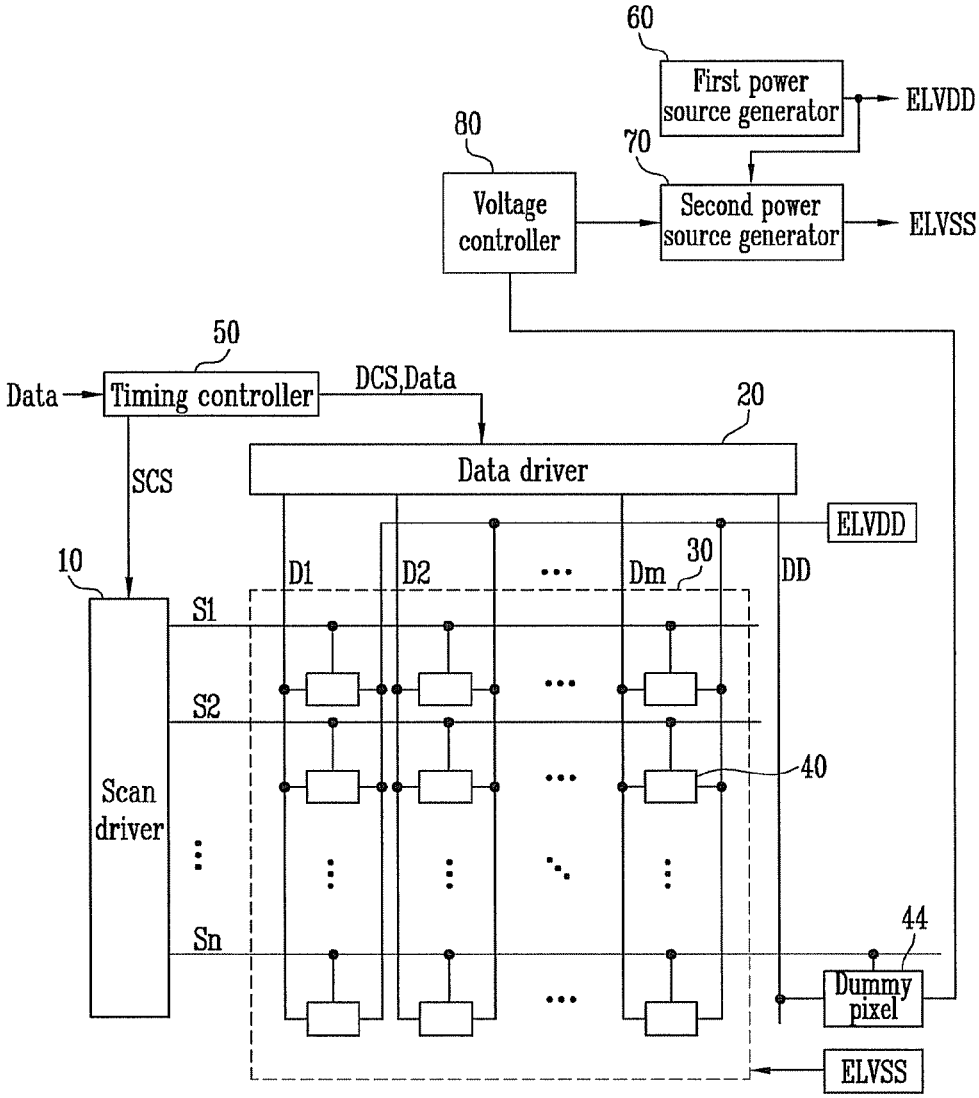
FIG. 3 illustrates an organic light emitting display according to a second embodiment of the present invention.

Meanwhile, it is illustrated that the voltage controller 80 is coupled to the specific pixel 42 included in the pixel unit 30. However, the present invention is not limited to the above. Actually, as illustrated in FIG. 3, the voltage controller 80 may be coupled to at least one dummy pixel 44 positioned in the region (that is, a non-display region) other than the pixel unit 30.

In this case, the dummy pixel 44 is coupled to a dummy data line DD and the scan line Sn. Although FIG. 3 shows that the nth scan line Sn is coupled to the dummy pixel 44 for convenience sake, the present invention is not limited thereto. Actually, the dummy pixel 44 may be coupled to any one of the first scan line S1 through the nth scan line Sn.

Meanwhile, the data driver 20 supplies the data signal corresponding to the maximum brightness (that is, the highest gray level) to the data line Dm or the dummy data line DD coupled to the specific pixel 42 at a predetermined interval so that the voltage information applied to the OLED in response to the temperature at which the OLED is currently driven can be observed.

Here, the predetermined interval is a time interval shorter than a time interval that a user can sense. In detail, in the case where the voltage information applied to the OLED in response to the temperature at which the OLED is currently driven is extracted from the specific pixel 42 and the time interval is set to be short, the maximum brightness generated by the specific pixel 42 that is observed by the user is a brightness that may deteriorate the display quality. Therefore, when the voltage information applied to the OLED in response to the temperature at which the OLED is currently driven is extracted from the specific pixel 42, the data signal corresponding to the maximum brightness is supplied to the data line Dm coupled to the specific pixel 42 at a time interval (for example, once per two seconds) so small that the user cannot sense. In this case, the data signal corresponding to the maximum brightness supplied to the data line Dm is synchronized with the scan signal supplied to the scan line S1 coupled to the specific pixel 42. Likewise, when the voltage information applied to the OLED in response to the temperature at which the OLED is currently driven is extracted from the dummy pixel 44, the data signal supplied to the dummy data line DD is at the predetermined interval.

In detail, the value of the second power source ELVSS changes by the voltage information applied to the OLED in response to the temperature at which the OLED is currently driven. Here, when the voltage of the second power source ELVSS rapidly changes, the change in the brightness can be observed by the user. Therefore, according to an aspect of the present invention, the predetermined interval is experimentally determined so that a rapid change in brightness is not generated by the pixel unit 30.

Figure 4:
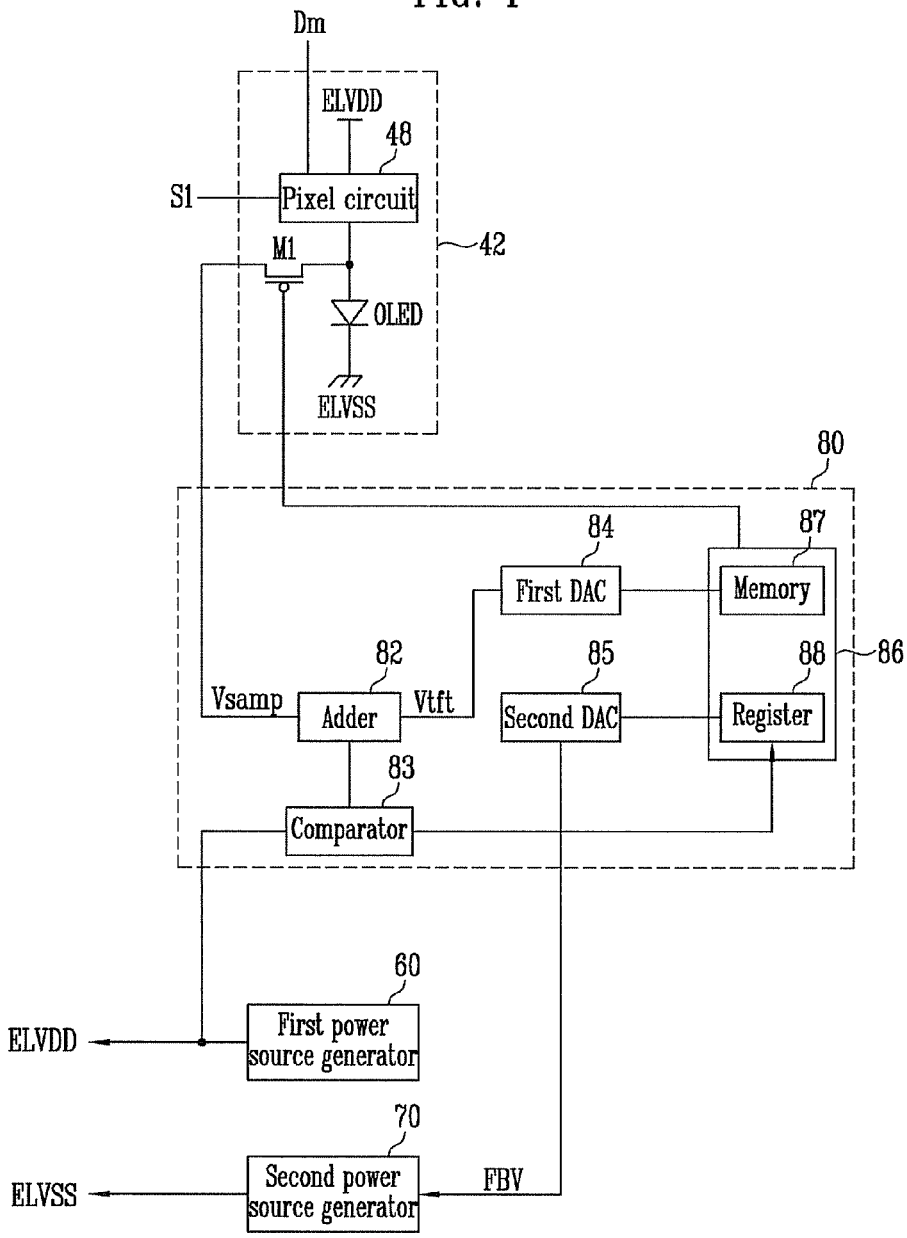
FIG. 4 illustrates a pixel and a voltage controller of FIG. 2.

FIG. 4 illustrates the pixel and the voltage controller of FIG. 2. Referring to FIG. 4, the pixel 42 includes a pixel circuit 48 to supply current to the OLED, the OLED that emits light in response to the current supplied from the pixel circuit 48, and the first transistor M1 positioned between the anode electrode of the OLED and the voltage controller 80.

The first transistor M1 is turned on at predetermined interval. When the first transistor M1 is turned on, the data signal corresponding to the maximum brightness is supplied to the data line Dm. Then, the OLED receives the maximum current corresponding to the brightest gray level. Whenever the first transistor M1 is turned on, the voltage controller 80 controls the voltage value of the second power source ELVSS in response to the voltage applied to the OLED. Here, when the first transistor M1 is turned on for a short time period, the voltage of the second power source ELVSS changes often such that a frequent change in the brightness of a panel may annoy the user. Therefore, with consideration to the size and resolution of the panel, the change in the brightness is experimentally determined so that it is not observable by the user.

The voltage controller 80 includes an adder 82, a comparator 83, a first digital-to-analog converter (hereinafter, referred to as DAC) 84, a second DAC 85, and a controller 86. The adder 82 adds the first voltage Vsamp to the second voltage Vtft to generate a third voltage when the current corresponding to the maximum brightness is supplied to the OLED of the pixel 42. The adder 82 supplies the generated third voltage to the comparator 83. The first voltage, Vsamp, is the voltage applied to the OLED and the second voltage, Vtft, is the voltage supplied from the first DAC 84.

The comparator 83 compares the third voltage with the voltage value of the first power source ELVDD (i.e. some predetermined voltage), and provides the comparison result to the controller 86. The controller 86 controls the turning on and off of the first transistor M1. The controller 86 includes a memory 87 and a register 88. The memory 87 stores the first data corresponding to the sum voltage of Vds_sat and Vmt. Here, since Vds_sat and Vmt are set as fixed values in each panel, Vds_sat and Vmt can be previously stored in the memory 87.

The first DAC 84 converts the first data supplied from the memory 87 into the second voltage (Vtft=Vds_sat+Vmt) to supply the second voltage to the adder 82. The register 88 supplies second data of j (j is a natural number) bits increased or reduced in response to the comparison result of the comparator 83 to the second DAC 85.

The second DAC 85 changes the second data supplied from the register 88 into an analog voltage FBV to supply the analog voltage FBV to the second power source generator 70. The second power source generator 70 generates the second power source ELVSS using the analog voltage FBV supplied from the second DAC 85. Here, the second power source ELVSS is generated by EQUATION 2.

$$ELVSS=\alpha\times FBV+\Delta V \quad \text{[EQUATION 2]}$$

In EQUATION 2, $\alpha$ represents a real number larger than 0 and $\Delta V$ represents to the voltage of the real number. In EQUATION 2, $\alpha$ and $\Delta V$ are experimentally determined so that the second power source ELVSS can be stably generated by the analog voltage FBV. Here, since $\alpha$ and $\Delta V$ are fixed values, the voltage of the second power source ELVSS is determined by the analog voltage FBV.

The operation processes will now be described in detail. The first data stored in the memory 87 is supplied to the first DAC 84. The first DAC 84 changes the first data supplied from the memory 87 into the second voltage Vtft to supply the second voltage Vtft to the adder 82.

The first transistor M1 is turned on by the controller 86. At this time, the current corresponding to the maximum brightness is supplied from the pixel circuit 48 to the OLED. Therefore, the first voltage Vsamp is applied to the OLED. Here, the value of the first voltage Vsamp is changed by the temperature at which the OLED is currently driven. For example, the first voltage Vsamp can be set at about 4V at a high temperature 80° C. and can be set at about 8V at a low temperature (−30° C.) in response to the same current.

The first voltage Vsamp applied to the OLED is supplied to the adder 82. At this time, the adder 82 adds the first voltage Vsamp to the second voltage Vtft to generate the third voltage and to supply the generated third voltage to the comparator 83. The comparator 83 compares the third voltage with the voltage value of the first power source ELVDD to supply the comparison result to the register 88. For example, the comparator 83 supplies a first control signal to the register 88 when the first power source ELVDD has a high voltage and supplies a second control signal to the register 88 when the third voltage is a high voltage.

The register 88 increases or reduces the bits of the second data in response to the control signals supplied from the comparator 83. For example, the comparator 83 increases the bits of the second data when the first control signal is input and reduces the bits of the second data when the second control signal is input. In other words, the comparator 83 increases and reduces the bits of the second data so that the third voltage output from the adder 82 can have a value similar to the value of the first power source ELVDD.

The second DAC 85 changes the second data into the analog voltage FBV to supply the analog voltage FBV to the second power source generator 70. The second power source generator 70 generates the second power source ELVSS using the analog voltage FBV supplied from the second DAC 85. Then, the voltage controller 80 generates the optimal voltage of the second power source ELVSS corresponding to the temperature at which the OLED is currently driven while repeating the above-described processes. When the voltage of the second power source ELVDD is changed to be set as the voltage value required at the corresponding temperature, the analog voltage FBV is not changed to be uniform with ELVDD.

In the above-described organic light emitting display according to an aspect of the present invention, the voltage applied to the OLED in response to the temperature is extracted and the voltage of the second power source ELVSS is controlled in response to the extracted voltage. As described above, when the voltage of the second power source ELVSS is controlled using the voltage extracted from the OLED, it is possible to minimize the power consumption. That is, since the voltage Vmo, as shown in EQUATION 1, is controlled to be a voltage suitable for the current driving temperature, the voltage needs not be set as a voltage having an unnecessarily large margin.

On the other hand, according to an aspect of the present invention, the voltage controller 80 can be coupled to the at least two specific pixels 42 or the at least two dummy pixels 44. In this case, the voltage controller 80 repeats the above-described processes in the specific pixels 42 or the dummy pixels 44. The register 88 controls the voltage of the second power source generator 70 only when the same result is obtained by the specific pixels 42 or the dummy pixels 44 or, in other words, only when the same control signal (the first control signal or the second control signal) is generated by the specific pixels 42 or the dummy pixels 44.

Figure 5:
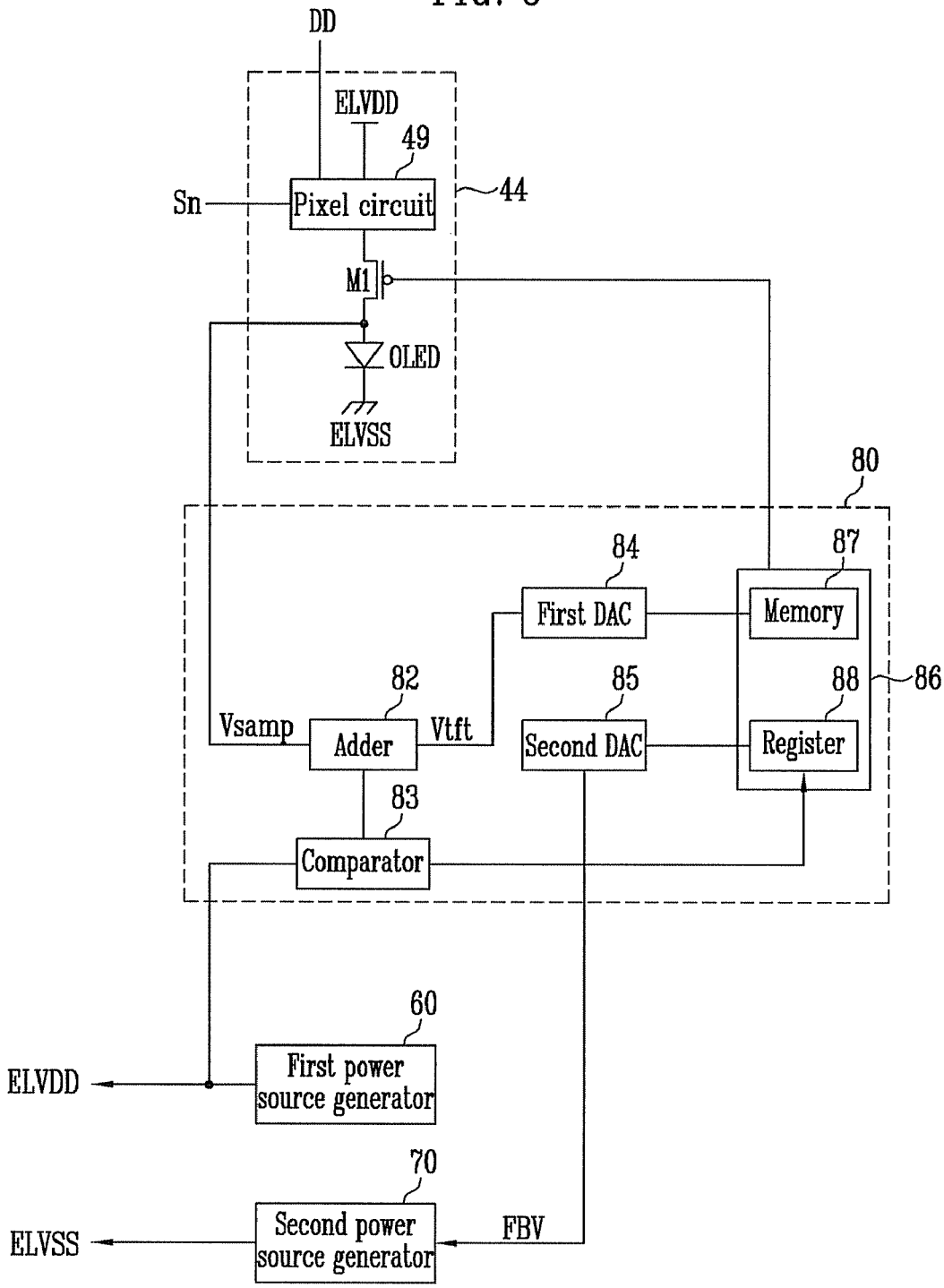
FIG. 5 illustrates a dummy pixel and the voltage controller of FIG. 3.

FIG. 5 illustrates the dummy pixel and the voltage controller of FIG. 3. In FIG. 5, the elements having the same function as the elements of FIG. 4 are denoted by the same reference numerals and a detailed description thereof will be omitted. Referring to FIG. 5, the dummy pixel 44 includes a pixel circuit 49 to supply current to the OLED, the OLED that emits light in response to the current supplied from the pixel circuit 49, and the first transistor M1 positioned between the anode electrode of the OLED and the pixel circuit 49. The anode electrode of the OLED is coupled to the adder 82.

When the dummy pixel 44 is compared with the specific pixel 42 illustrated in FIG. 4, it is noted that the position of the first transistor M1 changes. In the case of the dummy pixel 44, the first transistor M1 is positioned between the anode electrode of the OLED and the pixel circuit 49 to prevent undesired light from being generated by the dummy pixel 44.

The first transistor M1 is turned on by the controller 86 at a predetermined interval. When the first transistor M1 is turned on, the data signal corresponding to the maximum brightness is supplied to the dummy data line DD. Then, the OLED receives the maximum current corresponding to the brightest gray level.

Whenever the first transistor M1 is turned on, the voltage controller 80 controls the voltage value of the second power source ELVSS in response to the voltage applied to the OLED. Since the detailed operation processes of the voltage controller 80 were described with reference to FIG. 4, detailed description thereof will be omitted.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An organic light emitting display comprising a plurality of pixels positioned at intersections of data lines and scan lines, the organic light emitting display comprising:

the pixels including driving transistors positioned in an effective display region to control an amount of current that flows from a first power source to a second power source;

a data driver to supply data signals to the data lines;

a scan driver to supply scan signals to the scan lines;

a first power source generator to generate the first power source;

a second power source generator to generate the second power source; and a voltage controller to control the second power source generator so that a voltage of the second power source is changed in response to a first voltage applied to an organic light emitting diode (OLED) included in a specific pixel when a data signal corresponding to specific brightness is supplied from the data driver to the specific pixel.

2. The organic light emitting display as claimed in claim 1, wherein the specific pixel comprises a first transistor whose turning on point is controlled so that the first voltage is supplied to the voltage controller.

3. The organic light emitting display as claimed in claim 2, wherein the specific pixel is positioned in the effective display region.

4. The organic light emitting display as claimed in claim 3, wherein the specific pixel comprises:

the OLED;

a pixel circuit to supply current corresponding to the data signal to the OLED; and the first transistor positioned between an anode electrode of the OLED and the voltage controller.

5. The organic light emitting display as claimed in claim 2, wherein the specific pixel is positioned to be coupled to at least one scan line among the scan lines and a dummy data line in a non-display region other than the effective display region.

6. The organic light emitting display as claimed in claim 5, wherein the specific pixel comprises:

the OLED;

a pixel circuit to supply current corresponding to the specific brightness to the OLED; and the first transistor positioned between the pixel circuit and an anode electrode of the OLED.

7. The organic light emitting display as claimed in claim 6, wherein the voltage controller is coupled to the anode electrode of the OLED to measure the first voltage.

8. The organic light emitting display as claimed in claim 1, wherein the specific brightness is the maximum brightness corresponding to the brightest gray level.

9. The organic light emitting display as claimed in claim 2, wherein the voltage controller comprises:

a controller to control turning on and off of the first transistor;

a memory to store a sum voltage of a voltage for driving the driving transistor in a saturation region and a margin voltage caused by a process deviation of the driving transistor as first data;

a first digital-to-analog converter (DAC) to convert the first data into a second voltage;

an adder to add the first voltage to the second voltage to generate a third voltage;

a comparator to compare the third voltage with the voltage value of the first power source;

a register to generate second data whose bits are increased and reduced in response to a comparison result of the comparator; and a second DAC to convert the second data into an analog voltage.

10. The organic light emitting display as claimed in claim 9, wherein the register generates the second data whose bits are increased in response to the comparator determining that the first power source is larger than a predetermined voltage and whose bits are reduced in response to the comparator determining that the third voltage is larger than the predetermined voltage.

11. The organic light emitting display as claimed in claim 9, wherein the second power source generator reduces a voltage of the second power source when bits of the second data are reduced and increases the voltage of the second power source when the bits of the second data are increased.

12. The organic light emitting display as claimed in claim 9, wherein in the case where the voltage controller is coupled to at least two specific pixels, the register increases and reduces the second data only when the same comparison result is generated in the at least two specific pixels.

13. The organic light emitting display as claimed in claim 9, wherein the controller turns on the first transistor at a predetermined interval so that a change in brightness is not observed.

14. A method of driving an organic light emitting display comprising pixels to control current that flows from a first power source to a second power source, the method comprising:

storing a sum voltage of a voltage for driving transistors in a saturation region when the driving transistors included in the pixels supply current corresponding to the highest gray level and a voltage in consideration of a process deviation of the driving transistors in a memory as first data;

supplying current corresponding to the maximum gray level to an organic light emitting diode (OLED) included in at least one specific pixel through a data line;

comparing a third voltage that is a sum voltage of a first voltage extracted from the OLED in response to the current of the maximum gray level and a second voltage generated by changing the first data into an analog signal with the first power source; and controlling a voltage value of the second power source in response to the comparison result.

15. The method as claimed in claim 14, wherein the voltage value of the second power source is controlled so that the third voltage becomes similar to the voltage of the first power source.

16. A power supply for an organic light emitting display comprising a data driver, a scan driver and a power supply for a plurality of pixels having organic light emitting diodes (OLED) and transistors, the power supply comprising:

a first power source generator generating a first voltage;

a second power source generator generating a second voltage; and a voltage controller to control the second power source generator so that the second voltage is changed in response to the first voltage applied to the organic light emitting diode (OLED) included in a specific one of the pixels when a data signal corresponding to a specific brightness is supplied from the data driver to the specific pixel.

17. The power supply as claimed in claim 16, wherein the voltage controller comprises: a controller to control turning on and off of a first transistor of a pixel; a memory to store a sum voltage of a voltage for driving a driving transistor of the pixel the a saturation region and a margin voltage caused by a process deviation of the driving transistor as first data; a first digital-to-analog converter (DAC) to convert the first data into a second voltage; an adder to add the first voltage to the second voltage to generate a third voltage; a comparator to compare the third voltage with the voltage value of the first power source; a register to generate second data whose bits are increased and reduced in response to a comparison result of the comparator; and a second DAC to convert the second data into an analog voltage.

* * * * *

UNITED STATES PATENT AND TRADEMARK OFFICE

CERTIFICATE OF CORRECTION

PATENT NO. : 8,194,013 B2
APPLICATION NO. : 12/505652
DATED : June 5, 2012
INVENTOR(S) : Sang-Moo Choi It is certified that error appears in the above-identified patent and that said Letters Patent is hereby corrected as shown below:

On the Title Page

| | |
|---|---|
| Item (57) Abstract, line 12 | After "that"<br>Insert -- a -- |

In the Claims

| | |
|---|---|
| Column 10, Claim 17, line 47 | Delete "the"<br>Insert -- in -- |

Signed and Sealed this
Twenty-fifth Day of February, 2014

Michelle K. Lee

Michelle K. Lee
*Deputy Director of the United States Patent and Trademark Office*